US005712005A

United States Patent [19]

Monn

[11] Patent Number: 5,712,005

[45] Date of Patent: Jan. 27, 1998

[54] MEMORY BOX FOR STORING PHOTO AND THE LIKE

[76] Inventor: Lawrence H. Monn, 1838 Carroll Ave. Apt. 2, St. Paul, Minn. 55104

[21] Appl. No.: 439,298

[22] Filed: May 11, 1995

[51] Int. Cl.[6] ..... B65D 69/00

[52] U.S. Cl. ..... 428/34.1; 206/223; 428/542.8

[58] Field of Search ..... 428/7, 542.8, 34.1; 206/223

[56] References Cited

U.S. PATENT DOCUMENTS

| | | | |
|---|---|---|---|
| 2,019,098 | 10/1935 | Schrickel | 428/39 |
| 2,025,352 | 12/1935 | Lemon | 206/232 |
| 2,777,231 | 1/1957 | Bollin | 428/13 |
| 2,881,546 | 4/1959 | Gauthier | 428/39 |
| 3,581,882 | 6/1971 | Bish | 206/1.7 |
| 4,123,862 | 11/1978 | Dyer et al. | 40/729 |
| 4,584,042 | 4/1986 | Wandroik | 156/280 |
| 4,626,454 | 12/1986 | Sandman | 428/13 |
| 4,729,182 | 3/1988 | Sherman | 40/124 |
| 5,016,752 | 5/1991 | Haugen, Jr. | 206/455 |
| 5,040,216 | 8/1991 | Policht | 40/357 X |
| 5,129,522 | 7/1992 | Druskoczi | 206/574 |
| 5,397,156 | 3/1995 | Schach et al. | 206/424 X |
| 5,466,535 | 11/1995 | Higgins et al. | 428/518 X |

*Primary Examiner*—Henry F. Epstein
*Attorney, Agent, or Firm*—Jacobson & Johnson

[57] ABSTRACT

A kit for decorating photo album storage box with color photocopies of photographs from the photo album. The kit includes a photo album, a storage box for the photo album, a transparent acrylic gel adhesive, a brush for applying the adhesive, and a sheet of instructions. A method for decorating the photo album box is also disclosed. The steps include making a color photocopy of a color photograph, applying an acrylic adhesive to the rear side of the color photocopy, pasting the color photocopy to the outside surface of the storage box, and then applying a coating of the acrylic adhesive to the front picture side of the photocopy to protect the outside surface of the storage box.

8 Claims, 1 Drawing Sheet

MEMORY BOX FOR STORING PHOTO AND THE LIKE

FIELD OF THE INVENTION

The present invention relates generally to the art of decorating, particularly to decorating book storage boxes, and specifically to decorating book storage boxes for identifying on the outside of the box the subject matter of the book.

BACKGROUND OF THE INVENTION

A photo album is one means for storing and protecting photographs. A box for the photo album adds another level of protection for the photograph. However, neither the photo album nor the box may have an indication of what is inside either the photo album or the box.

The present invention provides a kit with a unique combination of components. Specifically, the combination includes a book which removably holds a plurality of sheet objects, a storage box for the book which is stiff and self-supporting, an adhesive which is transparent when dry, and instructions for teaching how to decorate the outside surface of the storage box from photocopies of sheet objects intended to be stored in the book. The photocopies are torn at the edges, a transparent acrylic adhesive is applied to the tornorn photocopies, and then the photocopies are pasted to the outer surface of the storage box. The transparent acrylic adhesive is applied on the pasted photocopies to give a protective layer to the photocopies.

The invention provides a kit with a uniquely missing component. The missing component is the very substrate utilized for decorating the photo album storage box. This substrate is a photocopy of one's own photograph.

The invention provides a kit with means for finishing the decoration of the storage box. After a transparent hard protective coating has been applied to the photocopies, a stain may be brushed on to the hard protective coating to provide an aesthetic tone to the photocopies. The stain may be permanent ink or an acrylic paint.

The invention provides a method with a step of making a color photocopy. A color photocopy permits an easier identification of the contents of the storage box and is more aesthetic. Furthermore, when coated on both sides with an acrylic gel, the photocopy has the appearance of an actual photograph.

The invention provides a user with the steps for altering the photocopies. Specifically, the photocopies may be torn along the edges and permitted to wrinkle. Such may give the finished storage box both an aesthetic and textured appearance.

The invention provides a kit and methods which are uniquely inexpensive. The substrate utilized is not the relatively expensive photograph, but the relatively inexpensive photocopy.

DESCRIPTION OF THE PRIOR ART

The Schrickel U.S. Pat. No. 2,019,098 teaches how a relatively few constituents or cut-outs may be used for composing a great number of pictures. The cut-outs have tongues for insertion into slots in a supporting board or easel. The cut-outs may be shifted or repositioned. The cut-outs may overlap.

The Lemon U.S. Pat. No. 2,025,352 shows a box for receiving a book having stereoscopic illustrations. The cover of the box has an opening with stereoscopic lenses in registry therewith to permit a prospective purchaser to examine the stereoscopic illustrations in the book without removing the lenses from the cover.

The Gauthier U.S. Pat. No. 2,881,546 teaches the coordinate division of an original picture or painting into equal sections or portions of the desired size and dividing the surface of the area on which the picture is to be reproduced into the same number of sections. By then transferring the outlines of the portions of the original picture lying in certain areas to the same areas on the new surface, the original picture is reproduced in outline or to any degree of detail desired.

The Bish U.S. Pat. No. 3,581,882 teaches a collage art kit including a picture surface having outlines of a picture, an overlay sheet having a reproduction of the outlines, glue, glaze, brush, and an instruction book.

The Dyer et al. U.S. Pat. No. 4, 123,862 teaches a kit for fabricating a decorative three-dimensional sculpture display assembly.

The Sherman U.S. Pat. No. 4,729,182 teaches a mobile of photographs which may be collapsed and mailed.

The Haugen, Jr. U.S. Pat. No. 5,016,752 teaches a picture container having the general shape and configuration of a book.

The Wandroik U.S. Pat. No. 4,584,042 teaches an artistic method and kit for creating an art form having a textured surface and which appears to be three-dimensional. The kit includes substrate materials, crayons, and a candle. The method teaches a step of coating a first substrate material with a protective material.

The Druskoczi U.S. Pat. No. 5,129,522 teaches a do-it-yourself book cover kit which includes a blank sheet of denim material sized to form a book cover, a decorative design pre-attached to the sheet, a tube of pigmented material, and a pre-threaded needle.

SUMMARY OF THE INVENTION

A kit for decorating a photo storage box with photocopies of photographs from the photo album to provide a visual indication of the nature of the contents of the storage box. The kit includes a photo album, a storage box for the photo album, an adhesive and a sheet of instructions and a method for decorating the photo album box include making a photocopy of a photograph, applying an acrylic adhesive to the rear side of the photocopy, pasting the photocopy to the outside surface of the storage box, and then applying a coating of the acrylic adhesive to the front picture side of the photocopy to protect the outside surface of the storage box.

BRIEF DESCRIPTION OF THE DRAWINGS

The illustrative embodiment may be best described by reference to the accompanying drawings where.

DESCRIPTION OF THE PREFERRED EMBODIMENT

Figure 1:
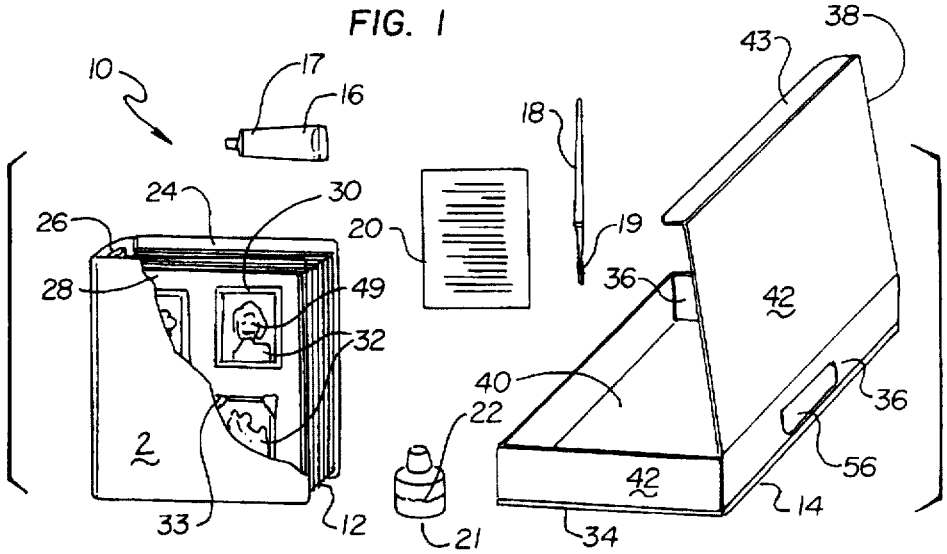
FIG. 1 shows an exploded, partially broken away, partially perspective view of a preferred form of a kit for decorating a photo album storage box according to the preferred teachings of the present invention, with the kit including a photo album storage box, a photo album, a tube of acrylic gel adhesive, a brush for applying the adhesive, and an instruction sheet.
Figure 2:
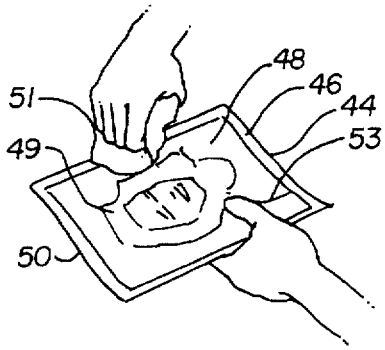
FIG. 2 shows the step of tearing the edges of a photocopy of a photograph in accordance with the instruction sheet of FIG. 1.
Figure 3:
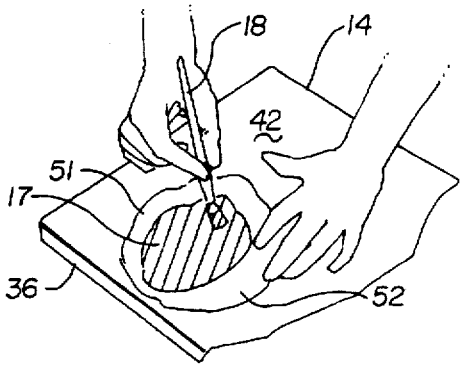
FIG. 3 shows the step of applying the adhesive to the back side of the photocopy of FIG. 2.
Figure 4:
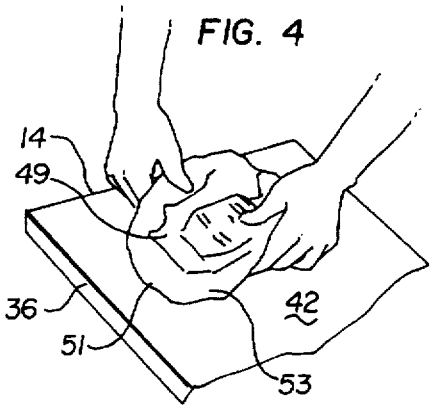
FIG. 4 shows the step of pasting the photocopy of FIG. 3 to the box.
Figure 5:
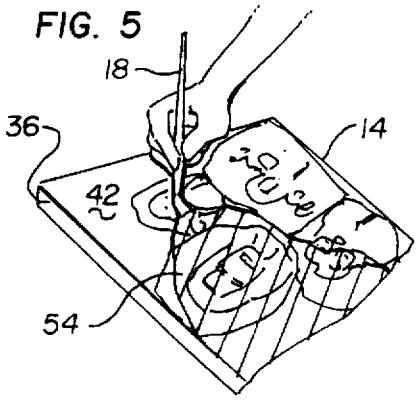
FIG. 5 shows the step of applying the final protective layer of the acrylic gel adhesive.

As shown in FIG. 1, the kit according to the teachings of the present invention is indicated by the reference numeral 10. The kit 10 includes a photo album 12, a photo album storage box 14, a tube 16 of an adhesive 17, a brush 18 with bristles 19 for applying the adhesive, and an instruction sheet 20. If desired, the kit may further include a small bottle 21 of permanent ink 22. I call my kit a MEMORY BOX™ kit.

More particularly, the photo album 12 includes relatively thick and durable, respective front and back covers 23 and 24 connected by a spine 26. Attached to the spine 26 between the covers 23, 24 are a plurality of pages 28 with pockets 30 for removably storing photographs 32. It should be noted that photo albums may take a great number of shapes, configurations, and sizes. It should further be noted that photo albums may include a great number of means, besides pockets, for removably storing photographs. One such means includes photo corners 33.

The storage box 14 is formed of relatively stiff material such as paper board or cardboard and is self-supporting. The box 14 includes a bottom panel 34, four side panels 36, and a top panel or cover 38 for being tucked inside of the box 14. The interior 40 of the box 14 is of a sufficient size to snugly hold and store the photo album 12. The panels 34, 36, and 38 together form an outer surface 42. The box 14 may include some means such as the flap 43 for holding the cover 38 in a closed position where the flap 43 frictionally engages the inside surfaces of three adjoining side panels 36. Such holding means may alternatively include, among other holding devices, a hook, strap, or interlocking tabs.

The adhesive or medium 17 is preferably a transparent acrylic gel. The adhesive 17 is adherable to the outer surface 42 and to photocopy paper. The adhesive 17 is spreadable with the brush 18. The acrylic adhesive 17 dries to form a clear, relatively hard finish. When a relatively thin layer of acrylic adhesive 17 is applied to both the front and rear sides of a sheet of photocopy paper and permitted to dry to form a clear, hard finish, the paper is provided with a relatively stiff, relatively glossy, photograph-like feel and appearance when on one of the side panels of the box 14.

The instruction sheet 20 includes printed instructions for the steps of the method of the present invention, including the steps of making a color photocopy from a color photograph, applying adhesive to the front and back sides of the photocopy, pasting the photocopy to the outside surface 42 of the box 14, applying a protective layer of the acrylic gel to the pasted photocopies, and staining the protective acrylic finish with diluted permanent ink.

The permanent ink 22 is preferably diluted for staining the protective finish of acrylic gel. The bottle 21 of permanent ink preferably includes ink of sepia tones because it is believed that most photographed subjects are people. Sepia tones are earth tones or dark brown tones. Sepia may also be described as a photograph with a brown tint or a dark grayish yellowish brown to dark or moderate olive brown. Sepia tones are preferably used according to the present invention for toning images of people. For example, portraits or weddings or wedding portraits or other romantic events, soft red and pinks may be used to further the theme of romantic love.

More particularly, the steps of the present invention include the step of making a photocopy or substrate 44 of a photograph intended to be stored in the photo album 12, which in turn is intended to be stored in the storage box 14. The photocopy 44 includes a white border 46, like a conventional photograph, and a rectangular picture portion 48 having a subject 49, like a conventional photograph. The photocopy 44 includes four edges 50. Preferably, the photocopy 44 is a color photocopy of a color photograph. Preferably, the photocopy 44 is a relatively clear photocopy on good quality white paper such as the COMPAT paper serial number 89201 which is a 28 pound, archival, acid free paper for laser printers for making color photographs. However, less expensive sheets of photocopy paper also work well. The price for a photocopy at a neighborhood copy center such as Kinko's® typically costs ten cents or less.

After the photocopy or photocopies have been made, it is preferred that the edges 50 of the photocopy 44 are torn to produce torn edges 51. It is even more preferable to tear the border 46 completely off the photocopy 44 so as to tear around the periphery of the subject 49. The torn edges may provide a textured feel to the finished product after the protective coating of acrylic gel has dried.

Preferably after the edges 50 have been torn off, a thin layer of the acrylic gel adhesive 17 is applied with the brush 18 to the back or blank side 52 of the photocopy 44. Preferably, the adhesive 17 is brushed onto the entire surface of the blank side 52.

The photocopy 44 is then pasted on the outside surface 42 of the box 14 with the image or picture side 53 visible. If desired, the photocopy 44 may be permitted to wrinkle, as the photocopy 44 may become somewhat wet after application of the adhesive 17, with such wrinkles remaining even after the photocopy 44 has been pasted on the box 14. Such wrinkles, along with the torn edges, provide a textured feel to the surface of the finished product.

After one photocopy 44 has been pasted on the box 14, it is preferable to wait about 30 seconds until another photocopy 44 is pasted on the box 14. Such a time period permits the adhesive 17 on the back of the photocopy 44 to dry or set to the outside surface 42 of the box 14. The steps of making photocopies, tearing the edges, applying the adhesive, and waiting for the pasted photocopy to dry are repeated until the box 14 is covered to the satisfaction of the artist. Preferably, a collage is assembled with the torn photocopies 44 overlapping and with the entire surface 42 being covered with torn and overlapped photocopies 44. It should be noted that the gel 17 is preferably applied to the back side 52 substantially immediately prior to laying or pasting the photocopy 44 on the box 14 as the gel 17 dries fairly quickly.

Then the visible or front sides 43 of the photocopies 44 are brushed with a thin layer of the acrylic gel adhesive 17 to provide a transparent, hard, protective finish or coating or seal 54 to the outside of the finished box 14. It is preferable that the edges of the panels, and a flap such as flap 55, also receive an application of the protective finish 54 as wear and tear may occur along these portions of the box 14. Further, this final protective layer provides a glossy photograph like appearance and feel to the outside of the photocopies 44.

Subsequently, after the protective layer or finish 54 has dried, the permanent, diluted ink of the bottle 21 may be applied to the finish 54 so as to stain the finish. The diluted ink may be brushed on with the brush 18 after the bristles 19 have been washed with soap and water. The permanent ink is preferably water based. Typically, 10–12 drops of undiluted, nonconcentrated permanent ink are dropped from an eyedropper into one-quarter of a cup of water. The application of diluted ink may be wiped off or repeated to suit the artist's tastes. It should be noted that a stain of an acrylic paint may be applied as an alternative to, or in combination with, the stain of permanent ink.

It should be noted that the front page of a newspaper may also be applied to the box 14 in the same manner as the photocopies 44. For example, the portion of the front page having the day, month, and year date may be applied to the storage box 14 storing a photo album 12 which in turn stores photographs 32 of birthdays, anniversaries or other time-related events. Such a newspaper portion may be applied to the back cover 34 of the box 14.

It should further be noted that a label 56 may be applied to the spine side panel 36. Such a label may include written information on the contents of the box 14 for identifying the photographs 32. The label may include spaces for the date, subject, and names.

It should be noted that, instead of the photo album 12, the book may be a scrap book, or a book which removably holds documents. For example, antique, or old and important documents such as found in museums are often removably stored in books or folders which in turn are stored in boxes.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

I claim:

1. A kit to enable a user to decorate a storage box so as to identify the contents of the box, comprising:

a) a storage box of a sufficient size for holding and storing sheet objects, the box being stiff and self-supporting and having an outside surface, said storage box having a cover that can be opened and closed to permit insertion or removable of an article therefrom;

b) an adhesive, said adhesive spreadable with a brush, said adhesive adherable to the outside surface of the box and to photocopy paper for securing the photocopy paper to the outside surface of the box; and c) means for instructing on the steps of making a photocopy with a front side and a back side from at least one of the sheet objects intended to be stored in the box, applying adhesive to the back side of the photocopy and the outside surface of the box, and then pasting the photocopy to the outside surface of the box whereby the box is turned into an aesthetic visual indicator for identifying the contents of the box.

2. The kit according to claim 1 including a book for storing within the storage box wherein the book comprises a photo album and the sheet objects comprise photographs intended to be stored in the photo album.

3. The kit according to claim 2 wherein the adhesive when allowed to dry on the outside surface of the box forms a relatively hard transparent protective coating.

4. The kit according to claim 3 wherein the adhesive comprises an acrylic.

5. The kit according to claim 3 further comprising means for staining the adhesive after the adhesive has formed a transparent protective coating.

6. The kit according to claim 5 wherein the means for staining the acrylic comprises permanent ink.

7. The kit according to claim 1 further comprising a brush for applying the adhesive.

8. The kit according to claim 3 further comprising a label for engaging the outside surface of the box and a pseudophotograph comprising a colored paneled photocopy of a color photograph, the color photocopy having a picture side and a back side, with the color photocopy being coated on both the picture side and the back side with a transparent acrylic.

* * * * *